United States Patent [19]

Roederer et al.

[11] Patent Number: 4,814,778

[45] Date of Patent: Mar. 21, 1989

[54] LARGE SCAN ANTENNA WITH FIXED MAIN REFLECTOR AND FIXED FEED, PARTICULARLY FOR USE AT ULTRAHIGH FREQUENCIES, CARRIED ON BOARD A SATELLITE AND A SATELLITE EQUIPPED WITH SUCH AN ANTENNA

[75] Inventors: Antoine G. Roederer, Noordwijk, Netherlands; Emmanuel Rammos, Copenhagen, Denmark; Peter Balling, Oegstgeest, Netherlands

[73] Assignee: Agence Spatiale Europeenne, France

[21] Appl. No.: 68,669

[22] Filed: Jun. 30, 1987

[30] Foreign Application Priority Data

Jul. 4, 1986 [FR] France ..... 86 09726

[51] Int. Cl.[4] ..... H01Q 3/46

[52] U.S. Cl. ..... 343/754; 343/837

[58] Field of Search ..... 343/DIG. 2, 761, 781 P, 343/837, 839, 840, 915

[56] References Cited

U.S. PATENT DOCUMENTS 4,044,361 8/1977 Yokoi et al. ..... 343/837
4,062,018 1/1978 Yokoi et al. ..... 343/754

FOREIGN PATENT DOCUMENTS 2982 11/1979 European Pat. Off. .
46996 10/1982 European Pat. Off. .
2517626 10/1983 France .

OTHER PUBLICATIONS

AIAA-84-0672, "A Beam-Steerable Antenna With an Offset Spherical Reflector for Earth Station", Watanabe, et al., pp. 117-124, 1984.
AIAA-76-303, "A Novel Earth Station Antenna for Geostationary Satellites", Akagawa, et al., pp. 451, et seq., 1976.

*Primary Examiner*—William L. Sikes
*Assistant Examiner*—B. Randolph
*Attorney, Agent, or Firm*—Andrus, Sceales, Starke & Sawall

[57] ABSTRACT

A large scan antenna, particularly for embarked use on board a satellite and for operation in the ultrahigh frequency range, of the type formed of a feed and a main fixed secondary reflector, the antenna being readily foldable into a launching configuration with a minimum of component elements, and comprising at least one guide G each formed of a first and a second parabolic secondary reflectors (12, 13) aligned optically along the axis of the wave guide G between the feed (10) and the main reflector (15), said wave guide G being on the one hand variable in length by moving at least one (13) of said secondary reflectors with respect to the other (12) along the axis (14) of the wave guide G, and on the other hand, rotatable about the axis (11) of the feed (10).

18 Claims, 6 Drawing Sheets

LARGE SCAN ANTENNA WITH FIXED MAIN REFLECTOR AND FIXED FEED, PARTICULARLY FOR USE AT ULTRAHIGH FREQUENCIES, CARRIED ON BOARD A SATELLITE AND A SATELLITE EQUIPPED WITH SUCH AN ANTENNA

FIELD OF THE INVENTION

The invention relates to a scan antenna of sufficiently simple and compact construction to be suitable for application to satellites.

The antenna of the present invention operates preferably, but not exclusively, at ultrahigh frequencies. It may further have a foldable construction, and provide for the transmission or reception of several independent scanning beams.

Up to now, ultrahigh frequency scan antennae have been designed essentially to be placed in earthbound stations for tracking geostationary satellites.

Recently, because of the congestion of the ether by radiowaves, the high geostationary orbit has allowed the designers of scn antennae to reduce the width of the tracking beams. The antenna thus constructed are therefore relatively more compact.

BACKGROUND OF THE INVENTION

Examples of construction of these known scan antennae may be found in Japanese literature. Watanabe et al. thus describe in the review AIAA PAPER 84-0672 1984 an antenna of the offset feed type shown in FIG. 5.

This antenna has a fixed feed 80, but includes a relatively complex set of mobile reflectors, namely two first rotary parabolic reflectors 81, 82 then a flat reflector 83 forming the periscopic feed system (beamwave guide (BWG) feeder). The resultant beam is then fed to the two auxiliary 84 and secondary 85 reflectors which are also mobile, before reaching the main fixed spherical reflector 86. Since the whole of the intermediate reflectors are mobile, sometimes about several axes, the assembly presents very considerable constructional requirements, incompatible with the constraints applicable to antennae or board satellites.

AKAGAWA et al. (AIAA PAPER 76-303) also describes a periscope feed antenna shown in FIG. 6. This antenna is also intended for tracking geostationary satellites. It is formed of a fixed feed 90 feeding a main slightly mobile reflector 91, after reflection of the feed beams from three secondary reflectors (92, 93, 94). Among these secondary reflectors, two are mobile, one allowing movement of the beam for tracking the geostationary satellite in its deviations in a direction perpendicular to its orbit, and the other providing tracking in the orbital direction.

Again, this system is only accomplished by means of a set of several mobile reflectors, which is not suitable for applications in outer space.

OBJECTS OF THE INVENTION

Consequently, the purpose of the antenna of the present invention is particularly to overcome the abovementioned drawbacks of existing systems.

A first object of the invention is to provide a scan antenna which is compact form and simple construction so as to meet better the requirements of strength, simplicity and reliability required for applications on board satellites.

Another object of the invention is to provide such an antenna which is readily foldable in a launching configuration then deployable into a configuration for orbital operation.

A third object of the invention is to provide such an antenna capable, in one of the embodiments, of delivering several independent scanning beams without adversely affecting either the compactness or the simplicity of construction.

A complementary object of the invention is to provide such an antenna which operates at ultrahigh frequencies, particularly in the S and Ka bands.

Main features of the invention

These objectives as well as others which will appear subsequently are provided by an antenna for use on board satellites in the ultrahigh frequency range, of the type formed of a periscopic (or else guided wave beam) feed and a main fixed reflector, wherein said antenna comprises at least one wave guide each formed of a first and a second secondary aligned parabolic reflectors inserted optically between the feed and the main reflector, said wave guide being of variable length by moving at least one of said secondary reflectors with respect to the other along the axis of the wave guide, and being rotary about the axis of the feed.

Thus, when the antenna is used for transmitting, the beams from the feed strike the main reflector at an angle depending on the length and on the angular position of the wave guide.

Furthermore, scanning of the resultant beam may be obtained by continuous variation of the rotational angle and/or of the length of the wave guide.

In a preferred embodiment, the two secondary reflectors of the wave guide are each mounted substantially at one end of a telescopic arm having two elements, said arm being articulated and set in rotation about the feed axis substantially at the level of the first reflector and being provided with a device for linear extension/retraction of the arm.

Other features and advantages of the invention will be clear from reading the following description of a preferred embodiment of the invention with reference to the accompanying drawings in which:

Figures

DESCRIPTION OF PREFERRED EMBODIMENTS OF THE INVENTION

Figure 1:
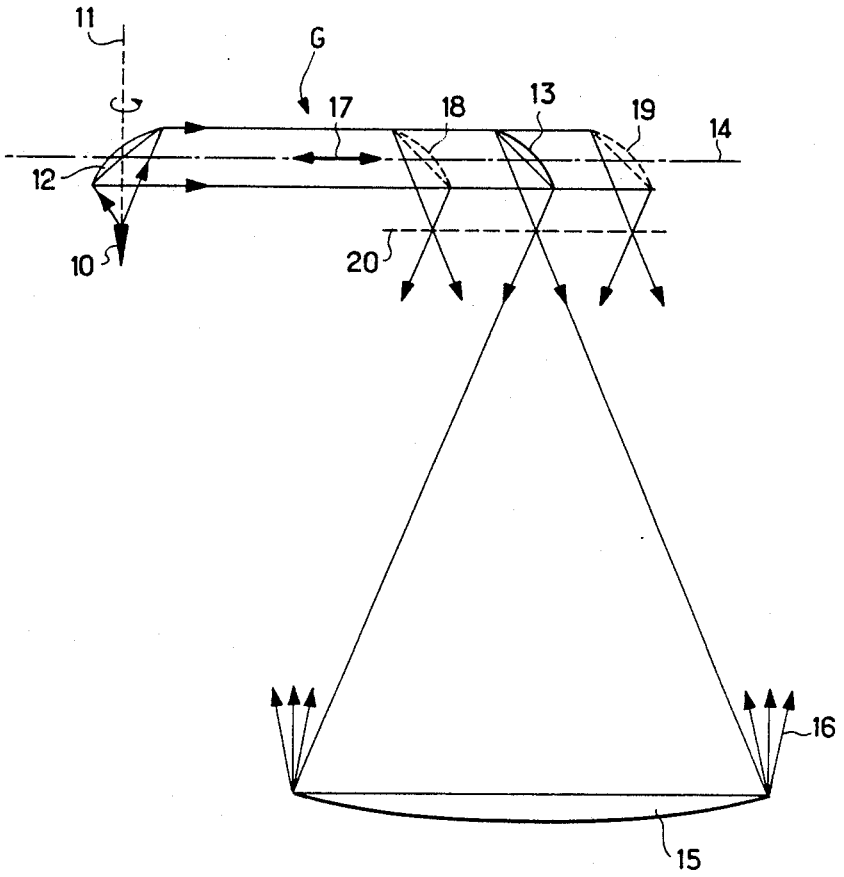
FIG. 1 shows the operating principle of the scan antenna of the invention.

The general diagram of the invention as shown in FIG. 1 shows the complete optical path in the transmitting mode.

The fixed feed 10 emits along the axis 11 in the direction of the first parabolic reflector 12 of the wave guide G. The resultant parallel beam is reflected toward the wave guide. This second reflector 13 is aligned with the first reflector 12 along the axis 14 so that the wave guide presents the lowest possible radiation losses.

Reflector 13, convex or concave, finally reflects the beam from the fixed feed 10 to the fixed main reflector 15 so as to form the output beam 16 of the antenna.

The two properties of the wave guide G, which form the essential characteristic of the present invention, also appear in FIG. 1.

First of all, whereas the feed 10 and the main reflector 15 are fixed, modification of orientation, and consequently scanning of the output beam 16, is provided in the plane of the drawing by moving the second parabolic reflector 13. This movement of reflector 13 takes place exclusively along the axis 14 of alignment of the two reflectors 12, 13 of the wave guide G, as shown schematically by the arrow 17. Thus, about its centered position, the reflector 13 may move either towards the left of the drawing (position 18) or towards the right (position 19).

In other words, a first means for obtaining modification of the orientation of the resultant beam 16 is to vary the length of the wave guide G, in this case by moving reflector 13 along the axis 14 of guide G.

Whatever the position of reflector 13, it reflects the image of the feed into the focal plane 20 of the main reflector 15. The minimum losses are obtained for the centered position of the secondary reflector 13 shown with a continuous line.

The second fundamental characteristic of the invention for modifying the orientation of the output beam 16 is the rotation of wave guide G about the axis 11 of feed 10.

This rotation must be made without any relative modification of the orientation of the two reflectors 12, 13 with respect to each other. In order words, it is the alignment axis 14 of the two reflectors 12, 13 which is driven in rotation about axis 11. In the example shown, because source 10 emits a spherical wave, rotation of the wave guide induces no deformation of the beam travelling through the wave guide. On the other hand, the incidence of the beam reflected by the secondary reflector 13 of guide G on the main reflector 15 is modified in direct relation with the angle of rotation of guide G about axis 11. The result is a corresponding modification of the orientation of the output beam 16.

It will then be understood that by a combined modification of the two above mentioned variable parameters, namely movement of the secondary reflector 13 with respect to reflector 12 along the axis 14 of the wave guide G and rotation of the whole of the wave guide G about axis 11 of the fixed feed 10, it is possible to orientate the output beam 16 through a large scanning range.

It will be seen that this result is obtained by means of an antenna whose feed 10 and main reflector 15 are fixed This allows then a very simple construction to be obtained for the whole of the antenna, since, with the feed fixed, there is no need to use rotary seals which cause considerable losses during high frequency operation, or else to provide for the mobility of a part of the transmission-reception module.

Because the heaviest and bulkiest element of the antenna, namely the main reflector 15 is stationary, economies are made both as far as the power is concerned which would have been required for moving it and the space required represented by its free movement.

Finally, the compactness of the wave guide which, through its retraction/extension and rotational movements allows scanning of the output beam 16 to be obtained provides compactness of the assembly, as well as the simplicity and safety of operations for folding up the antenna as will be seen further on.

Another advantage resulting from the fixed nature of the main reflector is that it is quite possible to use it for reflecting beams coming from several different feeds. In fact, since the position of the main reflector 15 remains fixed, the incidence of each beam on reflector 15 may be modified separately without influencing the other beams.

Figure 2:
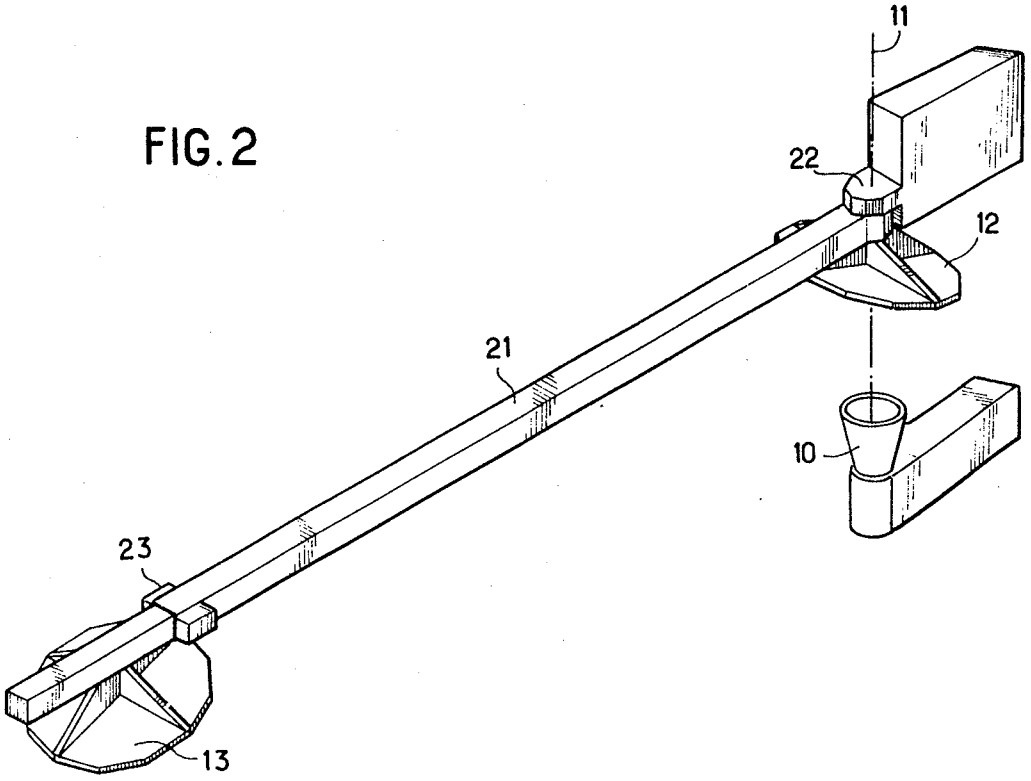
FIG. 2 shows an schematized embodiment of the antenna of the invention.

The two essential characteristics of the antenna of the invention may be used in the embodiment shown in FIG. 2. In this embodiment, the wave guide G is formed by two parabolic reflectors 12, 13 mounted on a rigid telescopic arm 21. This rigid arm is hinged at 22 for pivoting about the feed axis 11. Furthermore, the rigid reflector 13 is movable longitudinally along the arm 21 by means of a linear moving device 23.

Not only the means 22 for rotating arm 21 but also device 23 for moving the secondary reflector 13 may be formed by any known means.

By way of example, the antenna of FIG. 1 may be constructed so as to operate in the Ka band (about 26 GHz) with a beam which may be scanned in a cone with a half angle of 10°.

More precisely, the drawing corresponds to an operation of such an antenna in which the scanning is relatively large for a relatively large half power beamwidth (HPBW) of the order of 35° to 40°.

The dimensional characteristics of this embodiment are the following:

| | |
|---|---|
| focal distance of BWG reflectors 12, 13 of the wave guide G | 0.207 m |
| aperture diameter of BWG reflector 12, 13 | 0.356 m |
| subtended semi-angle of BWG reflectors 12, 13 | 23.3° |
| distance between the focal points of BWG reflectors 12, 13 for an incident beam centered on the main reflector 15 | 2.417 |
| movement of the second reflector 13 providing scanning of +/−10° | +/−0.563 m |
| focal distance of main reflector | 3.24 m |
| aperture diameter of main reflector | 2.7 m |
| height of the main reflector dish | 0.14 m |

In this non optimized example, the scanning losses for scanning over 10° are of the order of 2 dB of the invention, it is quite possible to insert a second additional reflector between reflectors 12, 13 of the wave guide G, provided that this additional reflector (not shown) is dichroic.

In this case, the wave guide may be advantageously fed from two feeds, whose operating frequencies are sufficiently separated for the dichroic reflector to reflect only the beam coming from one of the feeds, and is transparent for the other beam which will be reflected from reflector 13.

In this case, the same antenna with the same space requirement, allows two independent scanning beams to be obtained.

Furthermore, in the embodiment of wave guide G in which only two secondary reflectors 12, 13 are used, the secondary reflector 13 may be dichroic for the sole purpose of forming a selective reflection filter, targeted on the single range of frequencies of the radiations emitted by feed 10. It is then transparent for the radiation of other frequencies, which are therefore not reflected from the main reflector 15.

Figure 3:
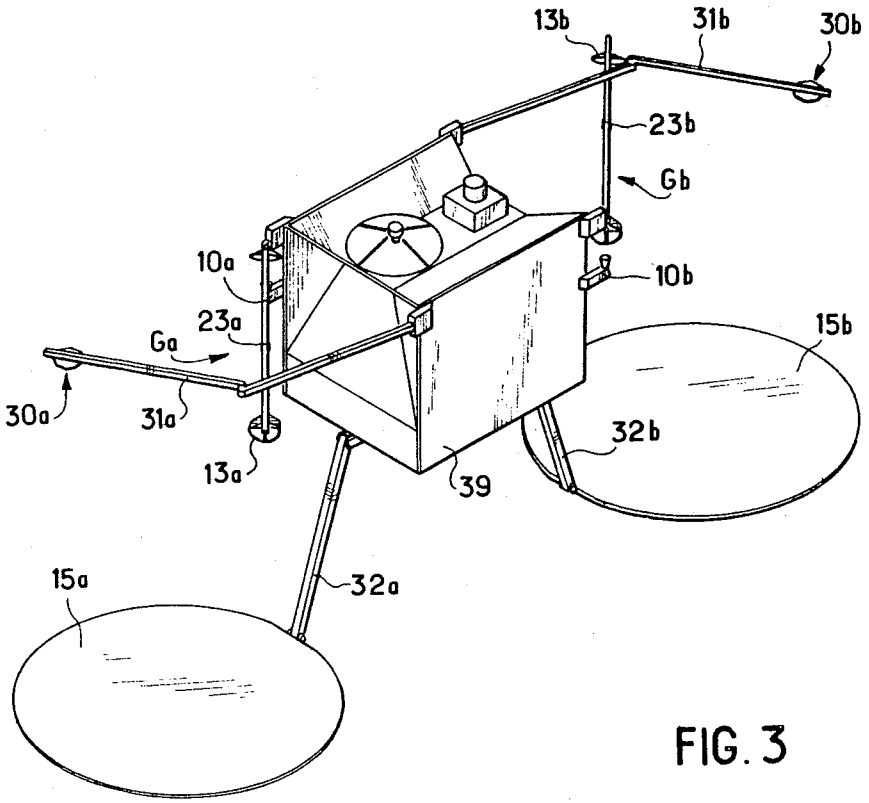
FIG. 3 shows the antenna of the invention in a deployed configuration on a satellite.

FIG. 3 is a perspective view of the antenna of the invention mounted on a satellite in a deployed configuration. It will be noticed that the satellite shown includes two antenna of the invention mounted symmetrically, with two main independent reflectors 15*a*, 15*b* fed by two different feeds 10*a*, 10*b* through two corresponding wave guides Ga, Gb. This double implantation of the antenna of the invention is shown in FIG. 3 on a satellite of Eurostar type, in combination, for each main reflector 15*a*, 15*b*, with an additional source 30*a*, 30*b* respectively, operating in a different wave range from that of feeds 10*a*, 10*b*.

The satellite shown is also provided with a useful load 39.

This satellite thus defined may advantageously be used as a data transmission relay satellite capable of producing four independent beams.

For example, each of the main reflectors 15*a*, 15*b* will be used to reflect, on the one hand, a beam in band Ka (25.25 to 27 GHz) fed by the wave guide Ga, Gb respectively, and on the other hand a beam in band S (2025 to 2300 MHz) fed by the additional sources (30*a*, 30*b*) respectively.

The wave guides Ga, Gb in band Ka are mounted on a telescopic arm of the type shown in FIG. 2, with a device 23*a*, 23*b* for extending or retracting the arm.

As far as it is concerned, the feed in band S, 30*a*, 30*b* for each main reflector 15*a*, 15*b* is mounted at the end of an articulated arm 31*a*, 31*b*. The principle chosen here for feed S is for example that of a printed feed network. It may for example be a question of a wide band strip wave guide formed of notched elements (for improving the directivity). Each of the printed feeds 30*a*, 30*b* is connected to the fixed transmission/reception module by rotary seals and cables which is acceptable for frequencies in band S. Of course, the wave guide system described above in connection with band Ka could also be used for band S.

The band S feeds 30*a*, 30*b*, move in the focal plane of the main reflectors 15*a*, 15*b* respectively. So as not to hinder the movements of the wave guides Ga, Gb, the second secondary reflector 13*a*, 13*b* is convex so that it can be placed in a plane closer to reflector 15*a*, 15*b*.

Of course, these embodiments in now way form a limitation of the scope of the present invention but simply illustrate the way in which they may be put into practice.

Figure 4:
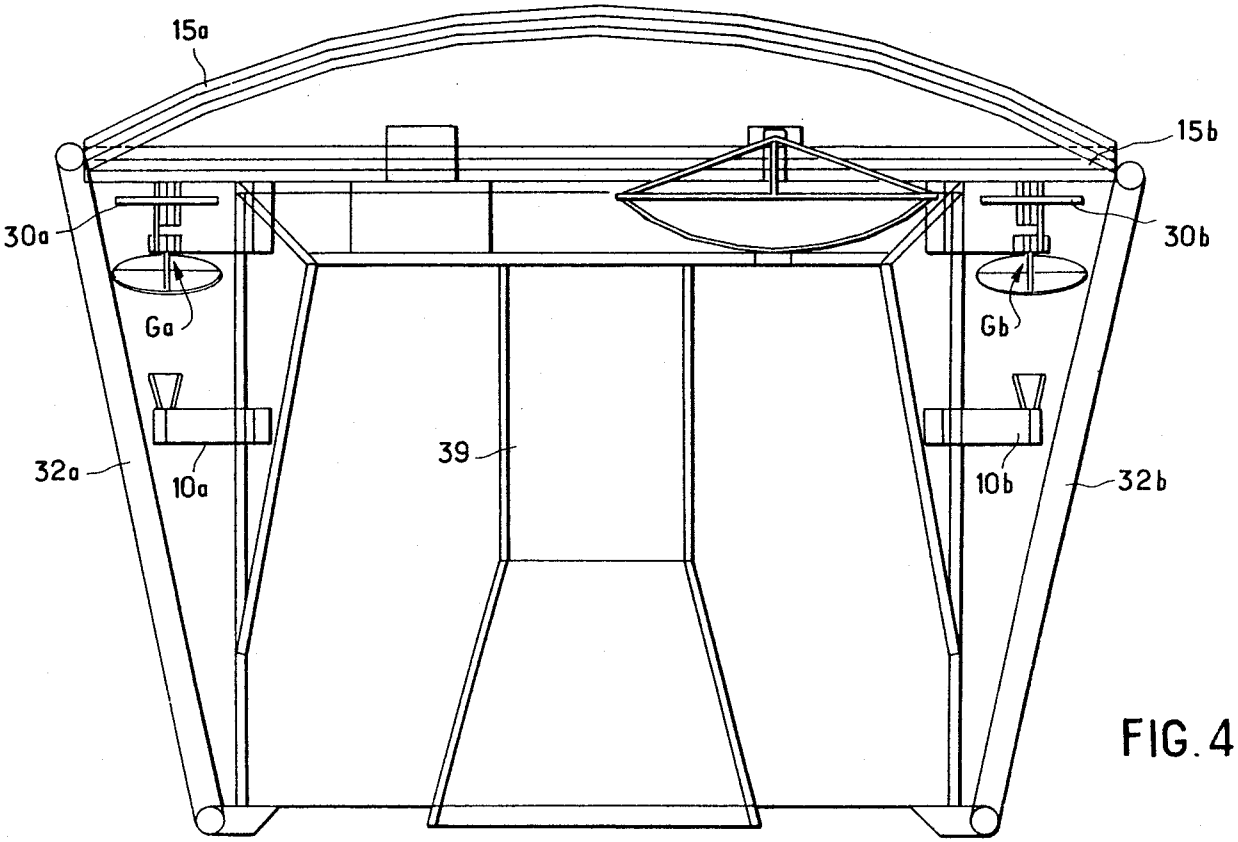
FIG. 4 shows the same satellite equipped with said antenna in a folded back launching position.
Figure 5:
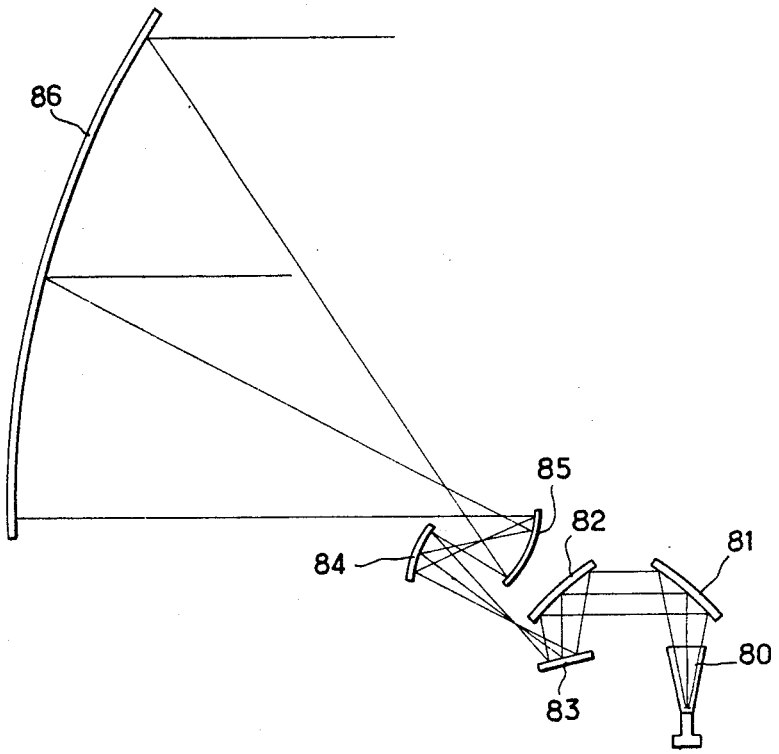
FIG. 5 PRIOR ART
FIG. 5 shows a periscopic feed antenna of the prior art.
Figure 6:
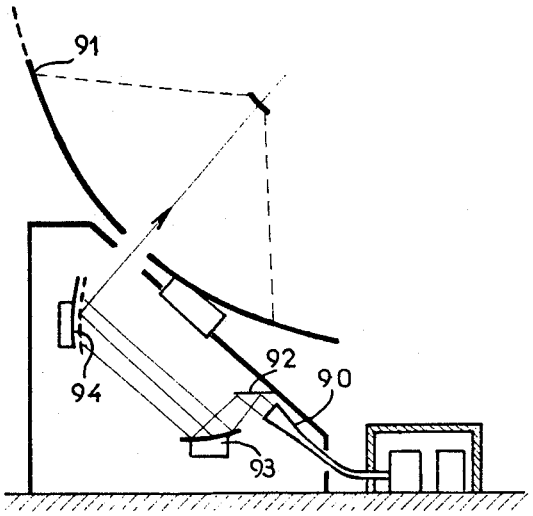
FIG.6 PRIOR ART
FIG. 6 shows a further feed antenna of the prior art.

FIG. 4 shows a view of the way in which the two antennae assemblies mounted on the satellite of FIG. 3 may be folded back in the launching position, for example when they are placed under the cover of an Ariane type launcher.

In fact, it can be seen that the two main reflectors 15*a*, 15*b* are completely folded back on the upper part of the satellite, the support arms 32*a*, 32*b* being brought vertically back against two opposite side walls of the useful load 39.

As far as they are concerned, the two arms 31*a*, 31*b* for extending the band S feed 30*a*, 30*b* are wound as it were along the upper part on two adjacent sides of the useful load. Finally, the wave guides Ga, Gb are applied, after retraction to a minimum distance between the pairs of secondary reflectors, slightly below the arms 31*a*, 31*b*.

The antenna of the invention answers then perfectly well the requirements for satellization and allows satellized assemblies to be obtained of great compactness in the launching phase, but of great flexibility in use, with a relatively wide scanning angle in the deployed configuration in orbit.

It will be noted that the configuration shown in FIGS. 3 and 4, having two main symmetrical reflectors each fed by two feeds operating in different ranges, also provides a very great flexibility in use, with a relatively wide scanning angle in the deployed configuration in orbit.

It will be noted that the configuration shown in FIGS. 3 and 4, having two main symmetrical reflectors each fed by two feeds operating in different ranges, also provides a very great flexibility in operation. It may even be envisaged, in the case where the satellite, used as a relay, is aimed towards another similar satellite in the two frequency ranges, to use each of the main reflectors 15*a*, 15*b* for a different frequency so as to avoid the shadow effects which would occur during coaxial positioning of the band S feed and of the second secondary Ka band reflector situated on the same side.

Of course, the operating frequencies taken as example in the above described embodiments in no way form limitations of the scope of the invention.

We claim:

1. A large sweep antenna for high frequency electromagnetic energy comprising;

a feed for the high frequency electromagnetic energy, said feed having an axis along which the energy travels;

a main reflector having a fixed orientation with respect to said feed; and at least one beam wave guide means coupling said feed and said main reflector, said wave guide means intersecting the axis of said feed, said wave guide means including first and second parabolic secondary reflectors spaced along said wave guide means, said wave guide means having an axis along which the energy travels, said secondary reflectors being aligned along the axis of the wave guide means, said wave guide means having means for altering the relative spacing of said secondary reflectors along said wave guide means, and said wave guide means being rotatable about the axis of said feed for angularly moving said wave guide means relative to said main reflector.

2. The antenna according to claim 1 wherein said wave guide means comprises a bar-like member having said first and second secondary reflectors mounted thereon.

3. The antenna according to claim 1 wherein said wave guide means is further defined as being variable in length for altering the relative spacing of said secondary reflectors.

4. The antenna according to claim 2 wherein said wave guide means includes a pair of telescoping elements, one of said secondary reflectors being mounted on each of said elements and wherein said antenna has means for moving said telescoping elements relative to each other and for rotating said wave guide means.

5. The antenna according to claim 1 wherein said wave guide means lies generally normal to the axis of said feed and wherein said wave guide means is rotated in a plane normal to said axis.

6. The antenna according to claim 1 further including a third secondary reflector in said wave guide means intermediate said first and second secondary reflectors, said third secondary reflector being aligned with said first and second secondary reflectors along the axis of said wave guide means, said third secondary reflector being dichroic.

7. The antenna according to claim 1 wherein said feed for high frequency electromagnetic energy is further defined as a first feed and wherein said antenna further includes a second feed for high frequency electromagnetic energy, said second feed being independent of said first feed.

8. Antenna according to claim 1, wherein said second secondary reflector of the wave guide means is convex.

9. Antenna according to claim 1, wherein said second secondary reflector of the wave guide means is dichroic.

10. A data communication satellite having a large sweep antenna for high frequency electromagnetic energy said antenna comprising; a feed for the high frequency electromagnetic energy, said feed having an axis along which the energy travels; a main reflector having a fixed orientation with respect to said feed; and at least one beam wave guide means coupling said feed and said main reflector, said wave guide means intersecting the axis of said feed, said wave guide means including first and second parabolic secondary reflectors spaced along said wave guide means, said wave guide means having an axis along which the energy travels, said secondary reflectors being aligned along the axis of the wave guide means, said wave guide means having means for altering the relative spacing of said secondary reflectors along said wave guide means, and said wave guide means being rotatable about the axis of said feed for angularly moving said wave guide means relative to said main reflector.

11. The satellite according to claim 10 wherein said wave guide means comprises a bar-like member having said first and second secondary reflectors mounted thereon.

12. The satellite according to claim 10 wherein said wave guide means is further defined as being variable in length for altering the relative spacing of said secondary reflectors.

13. The antenna according to claim 12 wherein said wave guide means includes a pair of telescoping elements, one of said secondary reflectors being mounted on each of said elements and wherein said antenna has means for moving said telescoping elements relative to each other and for rotating said wave guide means.

14. The antenna according to claim 10 wherein said wave guide means lies generally normal to the axis of said feed and wherein said wave guide means is rotated in a plane normal to said axis.

15. The satellite according to claim 10 further including a third secondary reflector in said wave guide means intermediate said first and second secondary reflectors, said third secondary reflector being aligned with said first and second secondary reflectors along the axis of said wave guide means, said third secondary reflector being dichroic.

16. The satellite according to claim 10 wherein said feed for high frequency electromagnetic energy is further defined as a first feed and wherein said antenna further includes a second feed for high frequency electromagnetic energy, said second feed being independent of said first feed.

17. The satellite according to claim 10, wherein said second secondary reflector of the wave guide means is convex.

18. The satellite according to claim 10, wherein said second secondary reflector of the wave guide means is dichroic.

* * * * *